United States Patent [19]

Scheuermann

[11] Patent Number: 4,928,404

[45] Date of Patent: May 29, 1990

[54] HEEL CUSHION

[75] Inventor: Rainer Scheuermann, Raisdorf, Fed. Rep. of Germany

[73] Assignee: Bauerfeind GmbH & Co., Kempen, Fed. Rep. of Germany

[21] Appl. No.: 293,222

[22] Filed: Jan. 4, 1989

[30] Foreign Application Priority Data

Jan. 8, 1988 [DE] Fed. Rep. of Germany ..... 8800116

[51] Int. Cl.[5] ..... A43B 13/12; A43B 13/18

[52] U.S. Cl. ..... 36/37; 36/35 R; 36/71; 36/92; 36/95

[58] Field of Search ..... 36/34 R, 35 R, 35 A, 36/37, 71, 88, 92, 95

[56] References Cited

U.S. PATENT DOCUMENTS

| | | | |
|---|---|---|---|
| 1,575,490 | 3/1926 | Krech | 36/37 X |
| 1,841,942 | 1/1932 | Fenton | 36/37 X |
| 2,055,072 | 9/1936 | Everston | 36/37 X |
| 2,863,231 | 12/1958 | Jones | 36/37 X |
| 3,859,740 | 1/1975 | Kemp | 36/71 |
| 4,747,410 | 5/1988 | Cohen | 36/43 X |
| 4,760,655 | 8/1988 | Mauch | 36/43 X |
| 4,794,707 | 1/1989 | Franklin et al. | 36/35 R X |

OTHER PUBLICATIONS

"Orthopädie Technik", 11/87, pp. 654–656, (trilingual) Article-English Title: Silicon Hell Cushion.

*Primary Examiner*—Thomas R. Hannon
*Attorney, Agent, or Firm*—Herbert Dubno

[57] ABSTRACT

A heel cushion composed of silicone rubber having a region which can be centrally or eccentrically located directly below the heel spur and composed of a softer silicone rubber than the balance of the heel cushion so that in heel regions subjected to higher pressure, that higher pressure will be absorbed by the softer material and the pressure throughout the back bottom part of the foot will be more uniform.

5 Claims, 1 Drawing Sheet

HEEL CUSHION

FIELD OF THE INVENTION

My present invention relates to a heel cushion and, more particularly, to a heel cushion composed of silicone rubber and, if desired, having an upstanding rim forming a cavity adapted to receive the heel of a wearer.

BACKGROUND OF THE INVENTION

Heel cushions have been provided heretofore in a variety of configurations and for various purposes. Mention may be made particularly of the description of a silicone heel cushion in Orthopadie Technik 11/87, pp. 654,656. A cushion of this type may be used to provide cushioning and support of the back of the foot to compensate for different leg lengths to damp shocks in walking and running, to absorb maximum impact and shock loads or the like.

In practice, it has been found that heel cushions of silicone rubber are highly desirable because this materially is relatively incompressible but is elastically yieldable.

Silicone rubbers, because of their yieldability, have been found to be particularly suitable for all of the foregoing purposes and are easily shapable to particular needs for various types of shoes.

The conventional heel cushion, however, is composed of the same silicone rubber throughout so that the properties of the material are uniform over the entire heel cushion. I have found, quite surprisingly, that this may be a drawback because the pressure distribution on the heel or lower rear part of the foot is substantially uniform. In certain regions, for example, at a heel spur or the calcaneal tuberosity, the pressure is generally much higher than elsewhere. The fact that the material has the same yieldability in the conventional heel cushion, results in a difference in the cushioning effects at the high pressure regions and elsewhere along the bottom of the heel. The result is a negative effect, especially in the case of a misstep or a particular stress upon the heel spur.

OBJECT OF THE INVENTION

It is, therefore, the principal object of the present invention to provide heel cushion which does not permit the development of excessive pressure loads and which minimizes the reaction of the cushion to areas of the heel subject to high pressure.

SUMMARY OF THE INVENTION

These objects and others which will become more readily apparent hereinafter are attained, in accordance with the present invention, by providing a heel pad or cushion which is composed of silicone rubber and which can be provided with an upstanding rim adapted to form a pocket or cavity receiving the heel of the wearer and which is provided with a region within the perimeter of the body of silicone rubber which is softer than the silicone rubber outside this region, the softer region being located substantially in the region directly below a heel spur or the calcaneal tuberosity of the heel.

Advantageously, this region is of a width which is approximately one-half the width of the heel cushion and has a dimension in the longitudinal direction of the heel cushion which is approximately one-fifth to one-half the length of the heel cushion. The region may be spaced inwardly from the perimeter of the heel cushion by about one-fifth to one-half the width of the softer region Depending upon requirements, the softer region can be located centrally of the heel cushion or eccentrically with respect to the latter, i.e. offset from a longitudinal median plane through the heel cushion.

According to a further feature of the invention, the softer region is generally circular.

The heel cushion can comprise a bed which tapers in thickness longitudinally and is surrounded by the rim. It can also be formed with the configuration of a so-called pronation cushion with an outer rise or as a supination cushion with an inner rise area.

The softer silicone rubber region results in a reduced pressure loading below the heel spur and thus a more uniform distribution of the pressure load to the bottom rear part of the foot.

Advantageously, the fabrication of the heel cushion of the invention can be facilitated by forming the underside of the cushion bed throughout of the harder silicone rubber and by inserting the softer silicone rubber in the harder silicone rubber, i.e. by embedding the softer silicone rubber in the cushion bed.

BRIEF DESCRIPTION OF THE DRAWING

The above objects, features and advantages of my invention will become more readily apparent from the following description, reference being made to the accompanying drawing in which.

SPECIFIC DESCRIPTION

Figure 1:
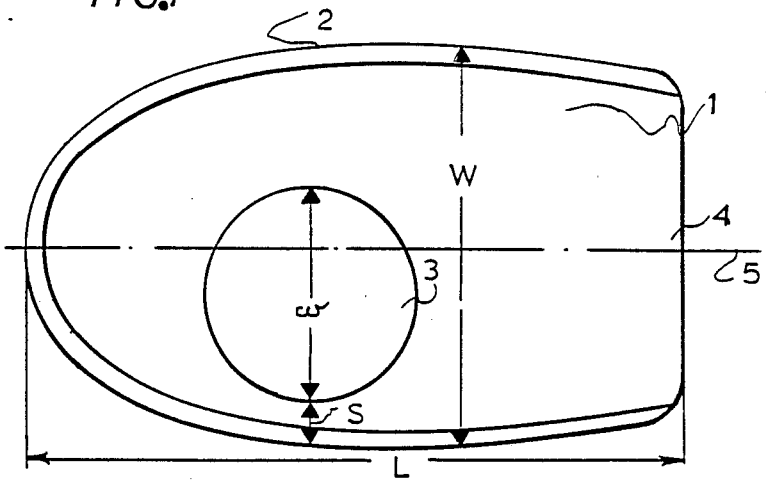
FIG. 1 is an elevational view of the heel cushion of the invention.
Figure 2:
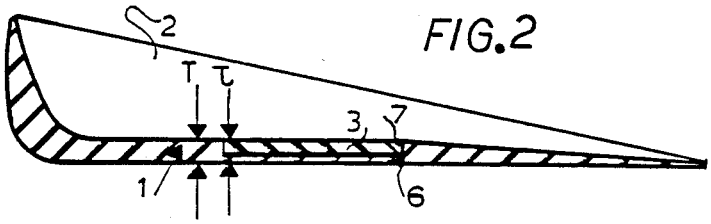
FIG. 2 is a longitudinal section through the heel cushion.

The heel cushion of the invention, as can be seen in FIG. 1, has a hard silicone rubber bed 1 formed along its periphery with a raised shell or rim 2 which tapers highly in thickness. The bed 1 tapers in the longitudinal direction also from the raised back toward a front edge 4. The longitudinal axis of the cushion has been shown at 5.

The cushion is composed of a silicone rubber with two parts of different hardness. The hardness may be controlled by fillers incorporated in the silicone rubber as is well-known per se.

Preferably, the underside of the silicone rubber bed is continuous and composed of the relatively harder rubber which is formed within cavity 7 in which a circular pad 13 of softer silicone rubber is embedded so as to be located below the calcaneal tuberosity or heel spur.

The thickness t of this circular region is less than the thickness T of the harder rubber portion of the cushion and the soft rubber disk is snugly received in the recess and bonded therein by heat and pressure.

The region 3 has a width w which is approximately one-third to two-thirds the width W of the heel cushion and can be offset from the axis 5 or centered thereon.

A minimum spacing s of one-fifth to one-half w can be provided from any edge of the heel cushion.

The length of the region 3, which is circular and thus has a length equal to its width, can be one-fifth to one-half the length L of the heel cushion.

The fact that the region 3 is softer than the remainder of the heel cushion ensures that the pressure loading of the rear lower part of the foot beneath the heel spur is reduced and essentially the same as the pressure load on the balance of the bottom rear of the foot when the heel cushion is under compression.

The cushion of the invention conforms in its outer perimeter to the shape of the back of a shoe and can be incorporated in athletic, tennis and canvas shoes or sneakers, as well as in dress shoes and boots.

Figure 3:
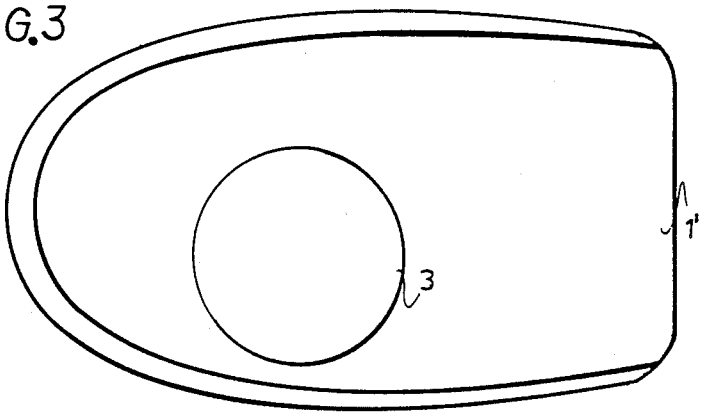
FIG. 3 is a view similar to FIG. 1, but illustrating another embodiment of the invention.

FIG. 3, of course, shows the embodiment of the invention in which the circular softer region 3 is located centrally of the cushion 1'.

What is claim:

1. A heel cushion for incorporation in footwear below the heel of a user, comprising a heel bed composed of a relatively hard silicone rubber, and means inserted to form a soft region of silicone rubber located below the heel of the wearer and adapted to absorb excessive pressure, said bed being continuous below said region and said region being embedded in said bed.

2. The heel cushion defined in claim 1 wherein said region is located centrally of said bed.

3. The heel cushion defined in claim 1 wherein said region is located eccentrically of said bed.

4. The heel cushion defined in claim 1 wherein said region is circular.

5. The heel cushion defined in claim 1 further comprising an upstanding shell formed unitarily with said bed and extending around at least a rear portion of the perimeter thereof.

* * * * *